US007992637B2

(12) United States Patent
Garcia

(10) Patent No.: US 7,992,637 B2
(45) Date of Patent: Aug. 9, 2011

(54) REVERSE FLOW IN-FLOW CONTROL DEVICE

(75) Inventor: Luis A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 12/061,426

(22) Filed: Apr. 2, 2008

(65) Prior Publication Data

US 2009/0250222 A1 Oct. 8, 2009

(51) Int. Cl.
*E03B 3/18* (2006.01)

(52) U.S. Cl. ..... 166/227; 138/37; 138/42

(58) Field of Classification Search ..... 166/227; 138/37, 40, 42, 43
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,412,841 | A | 12/1946 | Spangler |
| 2,762,437 | A | 9/1956 | Egan et al. |
| 2,810,352 | A | 10/1957 | Tumilson |
| 2,814,947 | A | 12/1957 | Stegemeier et al. |
| 2,942,668 | A | 6/1960 | Maly et al. |
| 2,945,541 | A | 7/1960 | Maly et al. |
| 3,326,291 | A | 6/1967 | Zandmer |

(Continued)

FOREIGN PATENT DOCUMENTS

CN 1385594 12/2002

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Kenneth Thompson
*Assistant Examiner* — Sean Andrish
(74) *Attorney, Agent, or Firm* — Mossman, Kumar & Tyler, PC

(57) ABSTRACT

A fluid flow control apparatus includes a flow path that conveys the fluid into a wellbore tubular, a first passage formed along the flow path, an annular space receiving the fluid from the first passage, and a second passage receiving fluid from the annular space. The passages may flow the fluid in an axial direction along the flow path. The apparatus may include an enclosure that receives a sleeve in which the passages are formed. The annular space may be formed between the sleeve and the enclosure. The passages may include an inlet that reduces a pressure of the fluid flowing through the inlet. The passages may include a bore and may include parallel conduits. The first and the second passages may convey the fluid in a first axial direction, and the annular space may be configured to convey the fluid in a direction opposite to the first axial direction.

20 Claims, 5 Drawing Sheets

U.S. PATENT DOCUMENTS

| | | | | |
|---|---|---|---|---|
| 3,385,367 | A | 5/1968 | Kollsman | |
| 3,419,089 | A | 12/1968 | Venghiattis | |
| 3,451,477 | A | 6/1969 | Kelley | |
| 3,675,714 | A | 7/1972 | Thompson | |
| 3,692,064 | A | 9/1972 | Hohnerlein et al. | |
| 3,739,845 | A | 6/1973 | Berry et al. | |
| 3,791,444 | A | 2/1974 | Hickey | |
| 3,876,471 | A | 4/1975 | Jones | |
| 3,918,523 | A | 11/1975 | Stuber | |
| 3,951,338 | A | 4/1976 | Genna | |
| 3,975,651 | A | 8/1976 | Griffiths | |
| 4,153,757 | A | 5/1979 | Clark, III | |
| 4,173,255 | A | 11/1979 | Kramer | |
| 4,180,132 | A | 12/1979 | Young | |
| 4,186,100 | A | 1/1980 | Mott | |
| 4,187,909 | A | 2/1980 | Erbstoesser | |
| 4,248,302 | A | 2/1981 | Churchman | |
| 4,250,907 | A | 2/1981 | Struckman et al. | |
| 4,257,650 | A | 3/1981 | Allen | |
| 4,287,952 | A | 9/1981 | Erbstoesser | |
| 4,415,205 | A | 11/1983 | Rehm et al. | |
| 4,434,849 | A | 3/1984 | Allen | |
| 4,491,186 | A | 1/1985 | Alder | |
| 4,497,714 | A | 2/1985 | Harris | |
| 4,552,218 | A | 11/1985 | Ross et al. | |
| 4,572,295 | A | 2/1986 | Walley | |
| 4,614,303 | A | 9/1986 | Moseley, Jr. et al. | |
| 4,649,996 | A | 3/1987 | Kojicic et al. | |
| 4,782,896 | A | 11/1988 | Witten | |
| 4,821,800 | A | 4/1989 | Scott et al. | |
| 4,856,590 | A | 8/1989 | Caillier | |
| 4,917,183 | A | 4/1990 | Gaidry et al. | |
| 4,944,349 | A | 7/1990 | Von Gonten, Jr. | |
| 4,974,674 | A | 12/1990 | Wells | |
| 4,998,585 | A | 3/1991 | Newcomer et al. | |
| 5,004,049 | A | 4/1991 | Arterbury | |
| 5,016,710 | A | 5/1991 | Renard et al. | |
| 5,132,903 | A | 7/1992 | Sinclair | |
| 5,156,811 | A | 10/1992 | White | |
| 5,333,684 | A | 8/1994 | Walter et al. | |
| 5,337,821 | A | 8/1994 | Peterson | |
| 5,339,895 | A | 8/1994 | Arterbury et al. | |
| 5,377,750 | A | 1/1995 | Arterbury et al. | |
| 5,381,864 | A | 1/1995 | Nguyen et al. | |
| 5,431,346 | A | 7/1995 | Sinaisky | |
| 5,435,393 | A | 7/1995 | Brekke et al. | |
| 5,435,395 | A | 7/1995 | Connell | |
| 5,439,966 | A | 8/1995 | Graham et al. | |
| 5,551,513 | A | 9/1996 | Surles et al. | |
| 5,586,213 | A | 12/1996 | Bridges et al. | |
| 5,597,042 | A | 1/1997 | Tubel et al. | |
| 5,609,204 | A | 3/1997 | Rebardi et al. | |
| 5,673,751 | A | 10/1997 | Head et al. | |
| 5,803,179 | A | 9/1998 | Echols | |
| 5,829,522 | A | 11/1998 | Ross | |
| 5,831,156 | A | 11/1998 | Mullins | |
| 5,839,508 | A | 11/1998 | Tubel et al. | |
| 5,873,410 | A | 2/1999 | Iato et al. | |
| 5,881,809 | A | 3/1999 | Gillespie et al. | |
| 5,896,928 | A | 4/1999 | Coon | |
| 5,982,801 | A | 11/1999 | Deak | |
| 6,068,015 | A | 5/2000 | Pringle | |
| 6,098,020 | A | 8/2000 | Den Boer | |
| 6,112,815 | A | 9/2000 | Boe et al. | |
| 6,112,817 | A | 9/2000 | Voll | |
| 6,119,780 | A | 9/2000 | Christmas | |
| 6,228,812 | B1 | 5/2001 | Dawson et al. | |
| 6,253,847 | B1 | 7/2001 | Stephenson | |
| 6,253,861 | B1 | 7/2001 | Carmichael et al. | |
| 6,273,194 | B1 | 8/2001 | Hiron et al. | |
| 6,305,470 | B1 | 10/2001 | Woie | |
| 6,325,153 | B1 | 12/2001 | Harrell | |
| 6,338,363 | B1 * | 1/2002 | Chen et al. | 138/26 |
| 6,367,547 | B1 | 4/2002 | Towers et al. | |
| 6,371,210 | B1 | 4/2002 | Bode et al. | |
| 6,372,678 | B1 | 4/2002 | Youngman et al. | |
| 6,419,021 | B1 | 7/2002 | George et al. | |
| 6,474,413 | B1 | 11/2002 | Barbosa et al. | |
| 6,505,682 | B2 | 1/2003 | Brockman | |
| 6,516,888 | B1 | 2/2003 | Gunnarson et al. | |
| 6,581,681 | B1 | 6/2003 | Zimmerman et al. | |
| 6,581,682 | B1 | 6/2003 | Parent et al. | |
| 6,622,794 | B2 | 9/2003 | Zisk | |
| 6,632,527 | B1 | 10/2003 | McDaniel et al. | |
| 6,635,732 | B2 | 10/2003 | Mentak | |
| 6,667,029 | B2 | 12/2003 | Zhong et al. | |
| 6,679,324 | B2 | 1/2004 | Boer et al. | |
| 6,692,766 | B1 | 2/2004 | Rubinstein et al. | |
| 6,699,503 | B1 | 3/2004 | Sako et al. | |
| 6,699,611 | B2 | 3/2004 | Kim et al. | |
| 6,786,285 | B2 | 9/2004 | Johnson et al. | |
| 6,817,416 | B2 | 11/2004 | Wilson et al. | |
| 6,840,321 | B2 | 1/2005 | Restarick et al. | |
| 6,857,476 | B2 * | 2/2005 | Richards | 166/278 |
| 6,863,126 | B2 | 3/2005 | McGlothen et al. | |
| 6,938,698 | B2 | 9/2005 | Coronado | |
| 6,951,252 | B2 | 10/2005 | Restarick et al. | |
| 6,976,542 | B2 | 12/2005 | Henriksen et al. | |
| 7,011,076 | B1 | 3/2006 | Weldon et al. | |
| 7,084,094 | B2 | 8/2006 | Gunn et al. | |
| 7,159,656 | B2 | 1/2007 | Eoff et al. | |
| 7,185,706 | B2 | 3/2007 | Freyer | |
| 7,290,606 | B2 | 11/2007 | Coronado et al. | |
| 7,318,472 | B2 | 1/2008 | Smith | |
| 7,322,412 | B2 | 1/2008 | Badalamenti et al. | |
| 7,325,616 | B2 | 2/2008 | Lopez de Cardenas et al. | |
| 7,395,858 | B2 | 7/2008 | Barbosa et al. | |
| 7,409,999 | B2 | 8/2008 | Henriksen et al. | |
| 7,469,743 | B2 * | 12/2008 | Richards | 166/242.1 |
| 7,673,678 | B2 | 3/2010 | MacDougall et al. | |
| 2002/0020527 | A1 | 2/2002 | Kilaas et al. | |
| 2002/0125009 | A1 | 9/2002 | Wetzel et al. | |
| 2003/0221834 | A1 | 12/2003 | Hess et al. | |
| 2004/0035578 | A1 | 2/2004 | Ross et al. | |
| 2004/0052689 | A1 | 3/2004 | Yao | |
| 2004/0144544 | A1 | 7/2004 | Freyer | |
| 2004/0194971 | A1 | 10/2004 | Thomson | |
| 2005/0016732 | A1 | 1/2005 | Brannon et al. | |
| 2005/0126776 | A1 | 6/2005 | Russell | |
| 2005/0171248 | A1 | 8/2005 | Li et al. | |
| 2005/0178705 | A1 | 8/2005 | Broyles et al. | |
| 2005/0189119 | A1 | 9/2005 | Gynz-Rekowski | |
| 2005/0199298 | A1 | 9/2005 | Farrington | |
| 2005/0207279 | A1 | 9/2005 | Chemali et al. | |
| 2005/0241835 | A1 | 11/2005 | Burris et al. | |
| 2006/0042798 | A1 | 3/2006 | Badalamenti et al. | |
| 2006/0048936 | A1 | 3/2006 | Fripp et al. | |
| 2006/0048942 | A1 | 3/2006 | Moen et al. | |
| 2006/0076150 | A1 | 4/2006 | Coronado | |
| 2006/0086498 | A1 | 4/2006 | Wetzel et al. | |
| 2006/0108114 | A1 | 5/2006 | Johnson | |
| 2006/0118296 | A1 | 6/2006 | Dybevik et al. | |
| 2006/0133089 | A1 | 6/2006 | Reid | |
| 2006/0175065 | A1 | 8/2006 | Ross | |
| 2006/0185849 | A1 | 8/2006 | Edwards et al. | |
| 2006/0272814 | A1 | 12/2006 | Broome et al. | |
| 2006/0273876 | A1 | 12/2006 | Pachla et al. | |
| 2007/0012444 | A1 | 1/2007 | Horgan et al. | |
| 2007/0039741 | A1 | 2/2007 | Hailey | |
| 2007/0044962 | A1 | 3/2007 | Tibbles | |
| 2007/0131434 | A1 | 6/2007 | MacDougall et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 * | 10/2007 | Richards et al. | 210/97 |
| 2007/0272408 | A1 | 11/2007 | Zazovsky et al. | |
| 2008/0035349 | A1 | 2/2008 | Richard | |
| 2008/0035350 | A1 | 2/2008 | Henriksen et al. | |
| 2008/0053662 | A1 | 3/2008 | Williamson et al. | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2008/0296023 | A1 | 12/2008 | Willauer | |
| 2008/0314590 | A1 | 12/2008 | Patel | |

| | | | | |
|---|---|---|---|---|
| 2009/0056816 | A1 | 3/2009 | Arov et al. | |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 * | 8/2009 | Garcia et al. | 166/373 |

FOREIGN PATENT DOCUMENTS

| | | | |
|---|---|---|---|
| GB | 1492345 | | 11/1977 |
| GB | 2341405 | | 12/2007 |
| JP | 59089383 | B2 | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, Mar.; pp. 13-18; 1997 Society of Petroleum Engineers.

Pressure Drop in Horizontal Wells and Its Effect on Production Performance; Dikken, Ben J.; SPE 19824, pp. 561-574, 1989; Koninklijke/ Shell E & P Laboratorium.

Restarick, Henry, Halliburton Energy Services; Horizontal Completion Options in Reservoirs With Sand Problems, Society of Petroleum Engineers, Copyright 1995.

Dikken, Ben J.; Koninklijke/Shell E & P Laboratorium, Pressure Drop in Horizontal Wells and Its Efect on Production Performance; Nov. 1990, Copyright 1990, Society of Petroleum Engineers.

"Rapid Swelling and Deswelling of Thermoreversible Hydrophobically Modified Poly(N-Isopropylacrylamide) Hydrogels Prepared by Freezing Polymerisation", Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer", Xue, W., Champ, S. amd Huglin, M. B. 2001, European Polymer Journal, 37(5) 869-875.

Dinarvand, R., D'Emanuele. A (1995) The use of thermoresponsive hydrogels for on-off release of molecules, J. Control. Rel. 36: 221-227.

Tanaka, T., Nishio, I., Sun, S.T., Ueno-Nisho, S. (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic-gels: Quantitative performance of the Donnan Thory, Macromolecules, 17: 2916-2921.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

REVERSE FLOW IN-FLOW CONTROL DEVICE

CROSS-REFERENCE TO RELATED APPLICATIONS

None.

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone or induce some other flow characteristic that effectively drains a formation.

The present disclosure addresses these and other needs of the prior art.

SUMMARY OF THE DISCLOSURE

In aspects, the present disclosure provides an apparatus for controlling a flow of a fluid into a wellbore tubular in a wellbore. The apparatus may include a flow path configured to convey the fluid into a flow bore of the tubular, a first passage formed along the flow path, an annular space receiving the fluid from the first passage, and a second passage receiving fluid from the annular space. The first passage and/or the second passage may flow the fluid in an axial direction along the flow path. In one arrangement, the apparatus may include a sleeve. The first passage and the second passage may be formed in the sleeve. Also, the apparatus may include an enclosure that receives the sleeve. The annular space may be formed between the sleeve and the enclosure. In aspects, the first passage may include a first inlet configured to reduce a pressure of the fluid flowing through the first inlet. Also, the second passage may include a second inlet configured to reduce a pressure of the fluid flowing through the second inlet. Either or both of the first passage and the second passage may include a bore. In aspects, either or both of the first passage and the second passage may include at least two parallel conduits. In embodiments, the first and the second passages may convey the fluid in a first axial direction, and the annular space may be configured to convey the fluid in a direction opposite to the first axial direction.

In aspects, the present disclosure provides an apparatus for controlling a flow of a fluid from a formation and into a wellbore tubular in a wellbore. The apparatus may include an enclosure, a tubular member disposed in the enclosure, an inflow passage formed in the tubular member, an annular space formed between the enclosure and the tubular member, and an outflow passage formed in the tubular member. The inflow passage may include an inlet configured to receive the fluid from an exterior of the enclosure and the annular space may be in fluid communication with the inflow passage. The outflow passage may include an inlet configured to receive the fluid from the annular space. In arrangements, the inflow passage and the outflow passage may be oriented parallel to one another. In aspects, the inflow passage may include a plurality of bores. Also, the outflow passage may include a plurality of bores. In arrangements, the inflow and outflow passages may convey the fluid in a first axial direction, and the annular space may convey the fluid in a direction opposite to the first axial direction. In aspects, the annular space may be defined by an inner surface of the enclosure and an outer surface of the sleeve.

In aspects, the present disclosure provides a method for controlling a flow of a fluid into a wellbore tubular in a wellbore. The method may include forming a flow path to convey the fluid into a flow bore of the wellbore tubular, flowing the fluid in a first direction along a first passage of the flow path, receiving the fluid from the first passage in an annular space; flowing the fluid along the annular space, directing the fluid from the annular space into a second passage of the flow path, and flowing the fluid in the first direction along the second passage. In embodiments, the first direction may have an axial component and the step of flowing the fluid along the annular space may include flowing the fluid in an axial direction opposite to the axial component of the first direction. In aspects, the method may include inducing a pressure drop in the fluid before flowing the fluid along the first passage. The method may also include inducing a pressure drop in the fluid while directing the fluid into a second passage. In arrangements, the first passage and the second passage of the flow path may be formed in a tubular member. Further, the annular space may be formed between the tubular member and an enclosure housing the sleeve.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
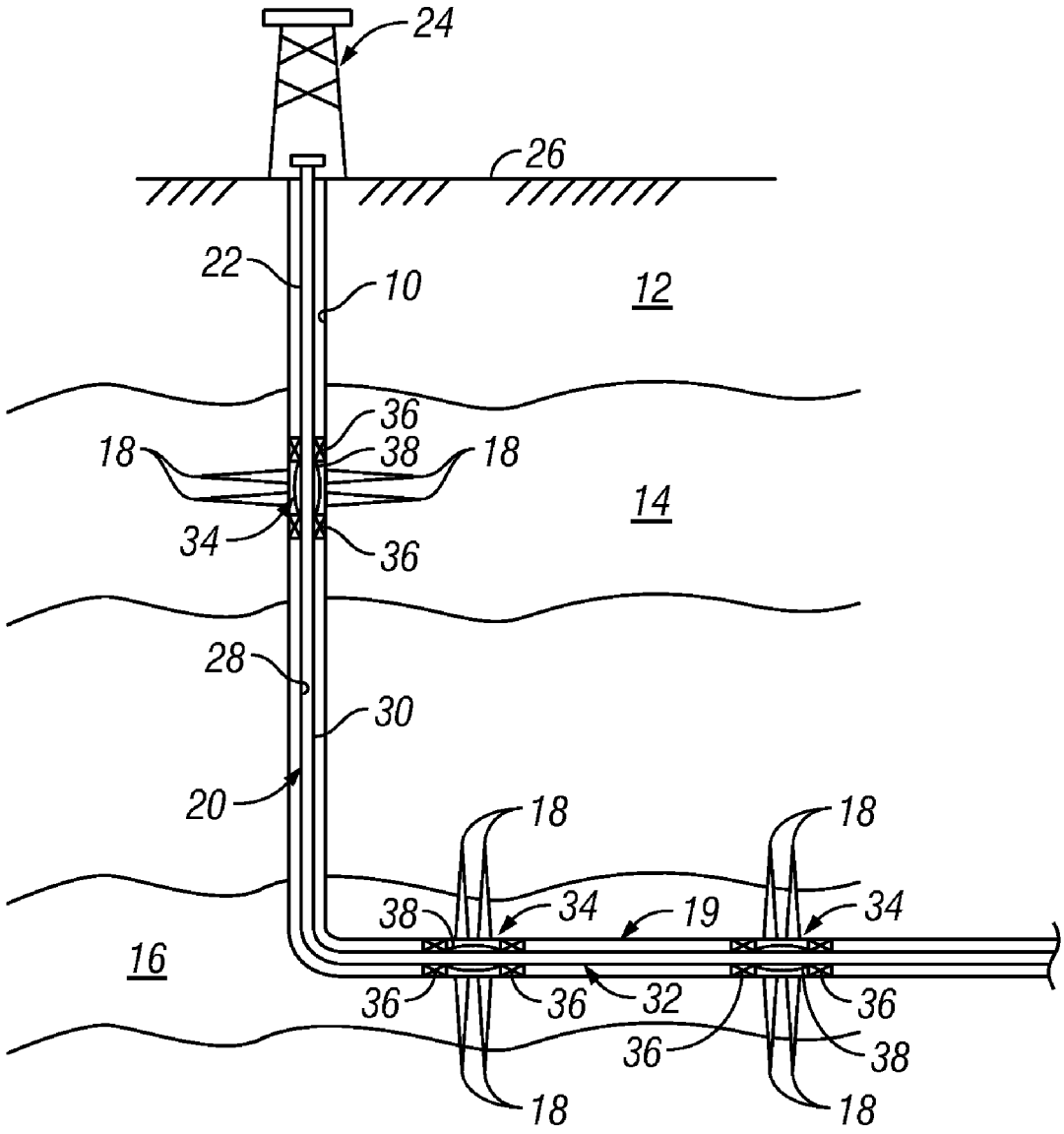
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flow bore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only two production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
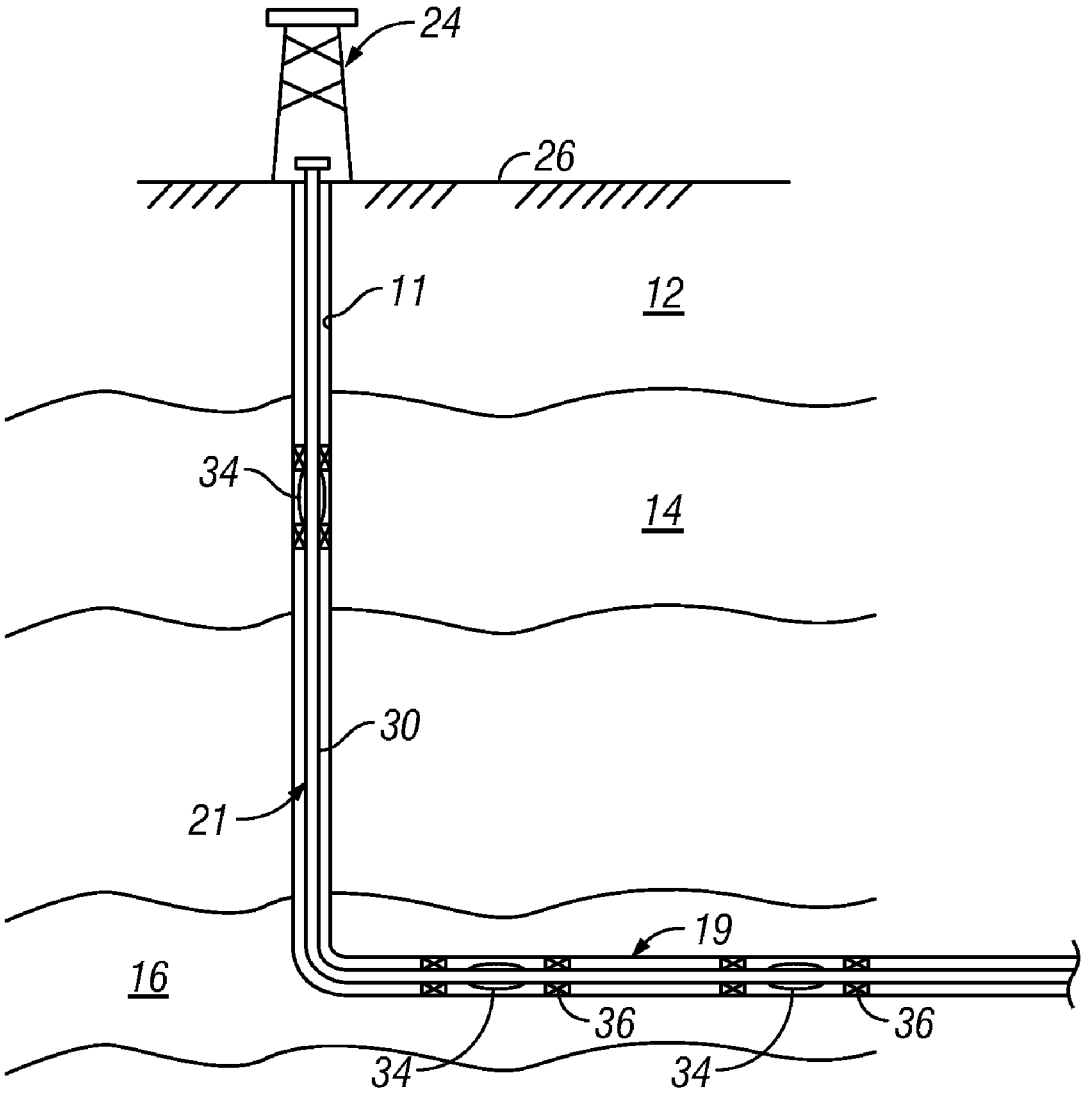
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and the packers 36 may be used to separate the production nipples. However, there may be some situations where the packers 36 are omitted. The nature of the production control device is such that the fluid flow is directed from the formation 16 directly to the nearest production nipple 34.

Figure 3:
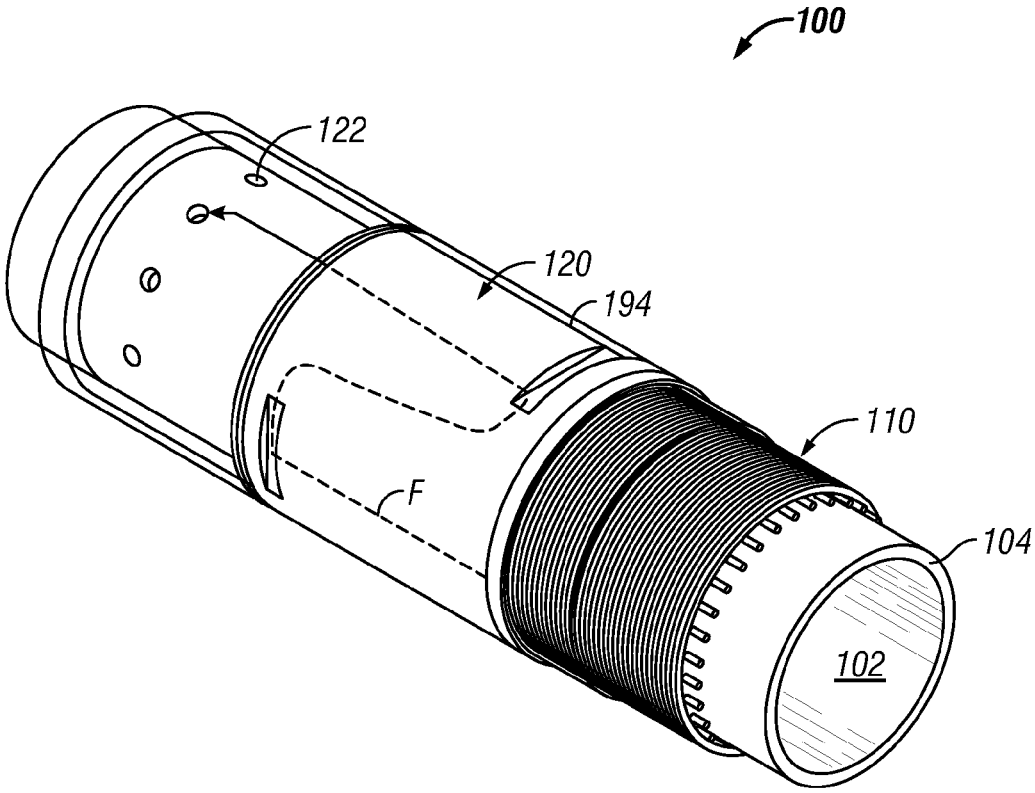
FIG. 3 is an isometric view of an exemplary production control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids and an in-flow control device 120 that controls overall drainage rate from the formation. The particulate control device 110 can include known devices such as sand screens and associated gravel packs. In embodiments, the in-flow control device 120 utilizes flow channels that control in-flow rate and/or the type of fluids entering the flow bore 102 of a tubular 104 via one or more flow bore orifices 122. Illustrative embodiments are described below.

Figure 4:
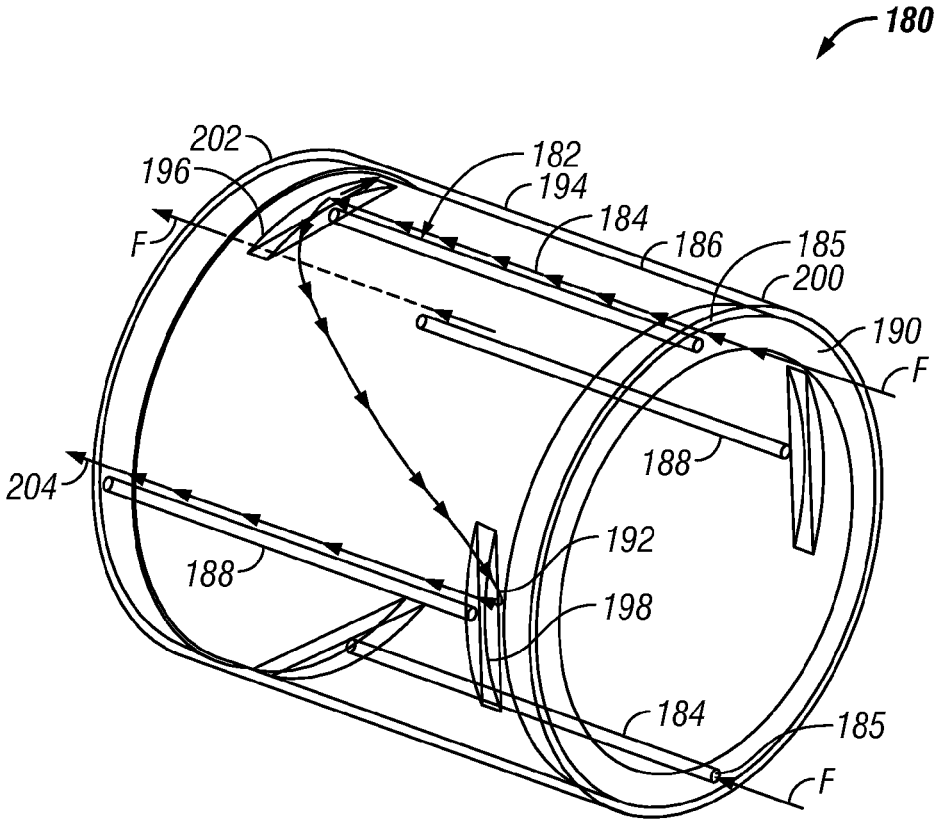
FIG. 4 is an isometric view of an in-flow control made in accordance with one embodiment of the present disclosure.
Figure 4A:
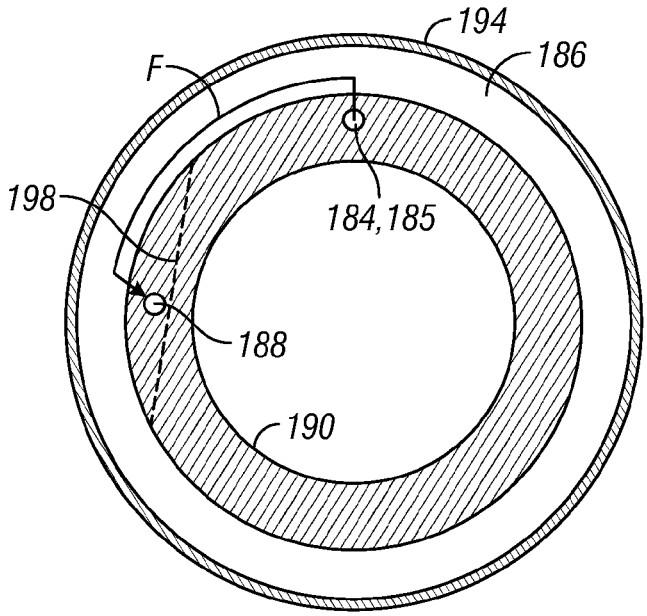
FIG. 4A is a sectional view of the FIG. 4 embodiment.

Referring now to FIG. 4, there is shown an exemplary in-flow control device 180 for controlling one or more characteristics of fluid flow from a formation into a flow bore 102 (FIG. 3). In embodiments, the in-flow control device 180 includes a series of flow passages 182 that may be configured to cause a specified flow characteristic in the in-flow control device 180 for a given fluid. Exemplary characteristics include, but are not limited to, flow rate, velocity, water cut, fluid composition, and pressure. The flow passages 182 may be formed as sections or segments of flow paths, with each segment or section having a specified configuration for imposing or inducing a desired flow characteristic.

In one embodiment, the flow passages 182 may include a first set of bores 184, an annular space 186, and a second set of bores 188. The first and the second bores 184 and 188 may be formed in a body 190 having an outer surface 192. In one embodiment, the body 190 may be a mandrel or sleeve-like tubular member 190, which, for simplicity, will be referred to as the sleeve 190. The sleeve 190 is positioned within an enclosure or housing 194 (FIG. 3 and FIG. 4). The annular space 186 may be formed between the housing 194 and the outer surface 192 of the sleeve 190.

During one exemplary use, a fluid F may initially flow via inlets 185 into the first set of bores 184. The fluid F flows through the first set of bores 184 in a first axial direction from a sleeve first end 200 to a sleeve second end 202. By axial direction, it is meant a direction along a longitudinal axis of the flow bore 102 (FIG. 3). A port 196 at the second end 202 permits the fluid F to flow out of the first set of bores 184 into the annular space 186. The fluid F floods the annular space 186 and continues to flow from the second end 202 back toward the first end 200. Inlets 198 at the sleeve first end 202 permit the fluid F to enter the second set of bores 188. The fluid F in the second set of bores 188 flows in the first axial direction from the first end 200 to the second end 202. The fluid F exits the second set of bores 188 via ports 204. The exiting fluid may thereafter flow through the in-flow control device 120 (FIG. 3) and into the flow bore 102 (FIG. 3). Thus, it should be appreciated that fluid flowing in the inflow control device 180 may be subjected to a plurality of reversals in flow direction. A first flow reversal occurs after the fluid exits the first set of bores or passages and enters the annular space. A second flow reversal occurs when the fluid flows into second set of bores from the annular space. Moreover, these flow reversals may be described as reversals along a longitudinal axis of the inflow control device 180.

As the fluid flows through the in-flow control device 180 as described above, the pressure of the fluid drops in a predetermined manner. First, the inlets 185 may function as orifices that induce a relative steep pressure drop in the vicinity of the inlets 185. This pressure drop accelerates the fluid flowing into and across the first set of bores 184. The fluid exiting the first set of bores 184 and collecting in the annular space 186 decelerate to a velocity in a larger area that allows for a venturi effect as the fluid flows into the secondary flow inlets 198. The venturi effect in the annular space 186 enables the inlets 198 to also function as orifices that induce an additional pressure drop in the vicinity of the inlets 198. This pressure drop accelerates the fluid flowing into and across in the second set of bores 188. Thus, in one configuration, the in-flow control device 180 imposes a pressure drop regime on the in-flowing fluid that includes at least two discrete pressure drops that are separated by a venturi effect.

It should be understood that the FIG. 4 embodiment is merely illustrative of the in-flow control devices that may utilize the teachings of the present disclosure. For example, the pressure reduction characteristics of the in-flow device 180 may be varied by increasing or decreasing the diameter of the bores 184 and 188, increasing or decreasing the number of the bores 184 and 188, and/or increasing or decreasing the length of the bores 184 and 188. Flow characteristics may also be varied by varying the shape, dimensions and/or orientation of the inlets 185 and ports 204. Flow characteristics may also be varied by varying the shape or dimensions of the annular space 186.

It should be understood that the shown arrangement is merely illustrative and not exhaustive of configurations for the flow passages 182. As shown, the bores 184 and 188 are shown as parallel passages that are circumferentially arrayed around the sleeve 190. In the embodiment shown, the bores 184 and 188 may be drilled and, therefore, have a circular profile. In other embodiments, the flow passage 182 may include slots or channels instead of bores. Thus, the sections of the flow passages 182 that are formed in the sleeve 190 may have any shape or cross-section that is suitable for conveying fluid. Additionally, the sections of the flow passages in the sleeve 190 need not be parallel with the longitudinal axis of the sleeve 190. Diagonal or curved passages may also be utilized in certain applications. Moreover, while sets of two bores 184 and 188 are shown, fewer or greater number of bores or passages may be used to convey fluid in a parallel arrangement across the in-flow control device 180.

It should be appreciated that the above-described features may, independently or in concert, contribute to causing a specified pressure drop along the in-flow control device 180. The pressure drop may be caused by changes in direction of the flowing fluid and/or the frictional forces along the flow path. In another aspect, the in-flow device 180 may be configurable to control both the magnitude of a total pressure drop across the in-flow control device 180 and the manner in which the total pressure drop is generated across the in-flow control device 180. By manner, it is meant that the nature, number and magnitude of the segmented pressure drops that make up the total pressure drop across the in-flow control device 180. For example, the annular space 186 may be adjustable to increase the available amount of volume for receiving fluid. Additionally, the bores 184 and 188 may be pluggable. That is, for example, while several bores 184 may be provided in the sleeve 190, one or more bore 184 may be blocked off to vary the pressure profile for the in-flow control device.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other wellbore tubulars.

Figure 5:
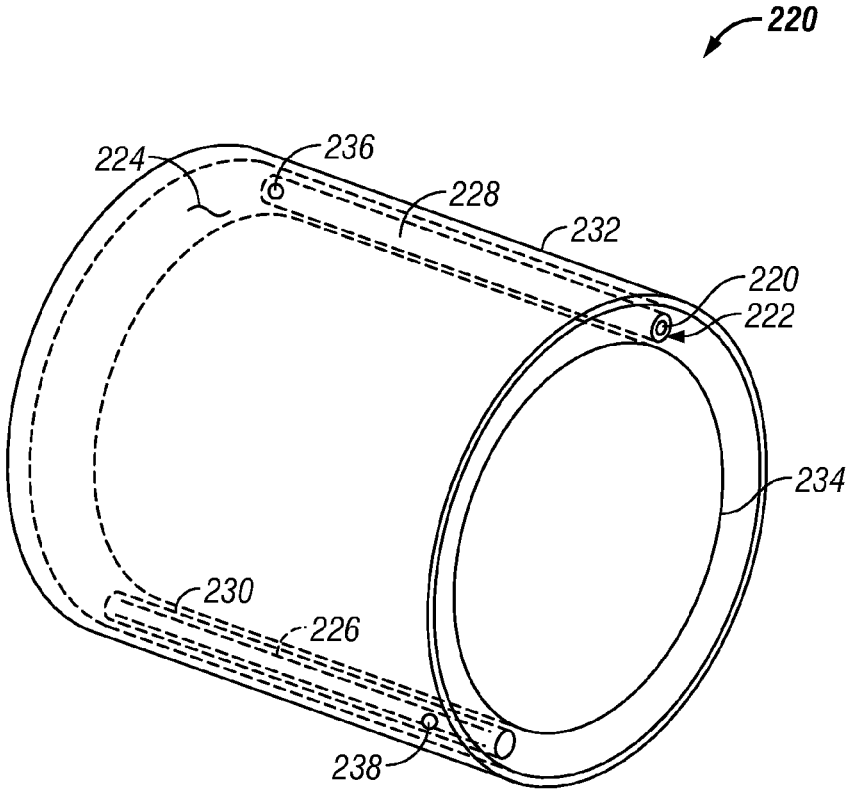
FIG. 5 is an isometric view of another in-flow control made in accordance with one embodiment of the present disclosure.
Figure 5A:
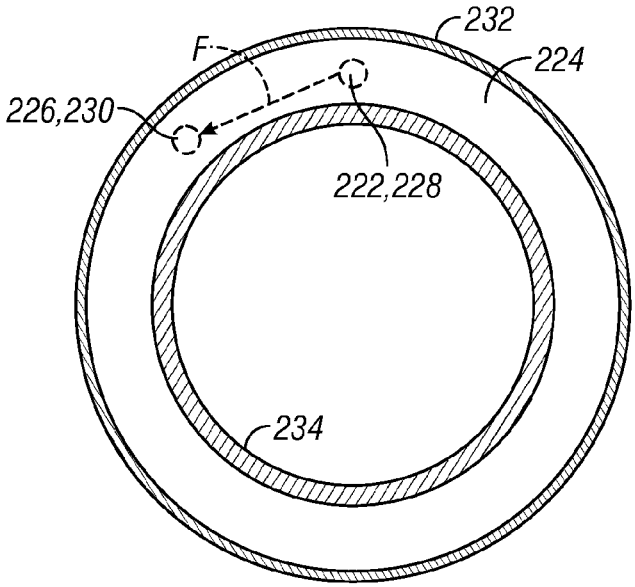
FIG. 5A is an end view of the FIG. 5 embodiment.

Referring now to FIG. 5, there is shown another embodiment for controlling in-flowing fluid. In FIG. 5, the flow passages 220 include a first or inflow bore 222, an annular space 224, and a second or outflow bore 226. The bores 222, 226 may be formed in tubes 228, 230 respectively. Additionally, the annular space 224 may be at least partially filled with a filler material (not shown) to control its volume. The annular space 224 may be formed between an outer enclosure 232 and an inner tube or mandrel 234. Fluid may flow out of the first flow bore 220 via an orifice 236 formed in the first tube 228 into the annular space 224. Fluid may flow from the annular space 224 into the second flow bore 224 via an orifice 238 formed in the second tube 230. During use, fluid flows through the first bore 222 and out of the orifice 236. The fluid reverses axial flow direction while flowing in the annular space 224 vis-à-vis the axial flow direction in the first bore 222. Thereafter, the fluid again reverses flow direction after entering the orifice 236 and fluid in the second bore 226.

It should be appreciated that what has been described includes, in part, an apparatus for controlling a flow of a fluid into a wellbore tubular in a wellbore. The apparatus may include a flow path that conveys the fluid into a flow bore of the tubular, a first passage formed along the flow path, an annular space receiving the fluid from the first passage, and a second passage receiving fluid from the annular space. The first passage and/or the second passage may flow the fluid in an axial direction along the flow path. In one arrangement, the apparatus may include a sleeve. The first passage and the second passage may be formed in the sleeve. Also, the apparatus may include an enclosure that receives the sleeve. The annular space may be formed between the sleeve and the enclosure. In aspects, the first passage may include a first inlet configured to reduce a pressure of the fluid flowing through the first inlet. Also, the second passage may include a second inlet configured to reduce a pressure of the fluid flowing through the second inlet. Either or both of the first passage and the second passage may include a bore. In aspects, either or both of the first passage and the second passage may include at least two parallel conduits. In embodiments, the first and the second passages may convey the fluid in a first axial direction, and the annular space may be configured to convey the fluid in a direction opposite to the first axial direction.

It should be appreciated that what has been described also includes, in part, an apparatus for controlling a flow of a fluid from a formation and into a wellbore tubular in a wellbore. The apparatus may include an enclosure, a tubular member disposed in the enclosure, an inflow passage formed in the tubular member, an annular space formed between the enclosure and the tubular member, and an outflow passage formed in the tubular member. The inflow passage may include an inlet configured to receive the fluid from an exterior of the enclosure and the annular space may be in fluid communication with the inflow passage. The outflow passage may include an inlet configured to receive the fluid from the annular space. In arrangements, the inflow passage and the outflow passage may be oriented parallel to one another. In aspects, the inflow passage may include a plurality of bores. Also, the outflow passage may include a plurality of bores. In arrangements, the inflow and outflow passages may convey the fluid in a first axial direction, and the annular space may convey the fluid in a direction opposite to the first axial direction. In aspects, the annular space may be defined by an inner surface of the enclosure and an outer surface of the sleeve.

It should be appreciated that what has been described also includes, in part, a method for controlling a flow of a fluid into a wellbore tubular in a wellbore. The method may include forming a flow path to convey the fluid into a flow bore of the wellbore tubular, flowing the fluid in a first direction along a first passage of the flow path, receiving the fluid from the first passage in an annular space; flowing the fluid along the annular space, directing the fluid from the annular space into a second passage of the flow path, and flowing the fluid in the first direction along the second passage. In embodiments, the first direction may have an axial component and the step of flowing the fluid along the annular space may include flowing the fluid in an axial direction opposite to the axial component of the first direction. In aspects, the method may include inducing a pressure drop in the fluid before flowing the fluid along the first passage. The method may also include inducing a pressure drop in the fluid while directing the fluid into a second passage. In arrangements, the first passage and the second passage of the flow path may be formed in a tubular member. Further, the annular space may be formed between the tubular member and an enclosure housing the sleeve.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid into a wellbore tubular in a wellbore, comprising:

a flow path configured to convey the fluid into a flow bore of the tubular;

a first passage formed along the flow path, the first passage configured to flow the fluid in an axial direction along the flow path;

an annular space receiving the fluid from the first passage; and a second passage receiving fluid from the annular space, the second passage being configured to flow the fluid in the axial direction along the flow path, wherein the annular space is formed between a radially outer surface of a body in which the first passage and the second passage are formed and an enclosure surrounding the body.

2. The apparatus according to claim 1 wherein the body includes a first port providing communication between the first passage and the annular space and a second port providing communication between the second passage and the annular space, the first and the second port being at opposing ends of the body and the annular space flowing the fluid between the opposing ends of the body.

3. The apparatus according to claim 1 wherein the body is a tubular member in which the first passage and the second passage are formed, and wherein the first passage conveys the fluid from a first end to a second end of the enclosure and the second passage conveys the fluid from the second end to the first end of the enclosure.

4. The apparatus according to claim 1 wherein the first passage includes a first inlet configured to reduce a pressure of the fluid flowing through the first inlet.

5. The apparatus according to claim 1 wherein the second passage includes a second inlet configured to reduce a pressure of the fluid flowing through the second inlet.

6. The apparatus according to claim 1 wherein one of the first passage and the second passage includes a bore.

7. The apparatus according to claim 1 wherein one of the first passage and the second passage includes at least two parallel conduits.

8. The apparatus according to claim 1 wherein the annular space is configured to convey the fluid in a direction opposite to the fluid conveyed in the first and second passages.

9. An apparatus for controlling a flow of a fluid from a formation and into a wellbore tubular in a wellbore, comprising:

an enclosure;

a tubular member disposed in the enclosure;

an inflow passage formed in the tubular member, the inflow passage having an inlet configured to receive the fluid from an exterior of the enclosure;

an annular space formed between the enclosure and a radially outer surface of the tubular member, the annular space being in fluid communication with the inflow passage; and an outflow passage formed in the tubular member, the outflow passage having an inlet configured to receive the fluid from the annular space.

10. The apparatus according to claim 9 wherein the inflow passage and the outflow passage are oriented parallel to one another.

11. The apparatus according to claim 9 wherein the inflow passage includes a plurality of bores.

12. The apparatus according to claim 9 wherein the outflow passage includes a plurality of bores.

13. The apparatus according to claim 9 wherein the inflow and outflow passages convey the fluid in a first axial direction, and the annular space conveys the fluid in a direction opposite to the first axial direction.

14. The apparatus according to claim 9 wherein the annular space is defined by an inner surface of the enclosure and a radially outer surface of the tubular member.

15. A method for controlling a flow of a fluid into a wellbore tubular in a wellbore, comprising:

forming a flow path to convey the fluid into a flow bore of the wellbore;

flowing the fluid in a first direction along a first passage of the flow path;

receiving the fluid from the first passage in an annular space;

flowing the fluid along the annular space;

directing the fluid from the annular space into a second passage of the flow path; and flowing the fluid in the first direction along the second passage, wherein the annular space is formed between a radially outer surface of a body in which the first passage and the second passage are formed and an enclosure surrounding the body.

16. The method according to claim 15 wherein the first direction has an axial component and the flowing the fluid along the annular space includes flowing the fluid in an axial direction opposite to the axial component of the first direction.

17. The method according to claim 15 further comprising inducing a pressure drop in the fluid before flowing the fluid along the first passage.

18. The method according to claim 15 further comprising inducing a pressure drop in the fluid while directing the fluid into a second passage.

19. The method according to claim 15 wherein the body is a tubular member.

20. The method of according to claim 19, wherein the annular space conveys fluid from a first end of the enclosure to a second end of the enclosure.

* * * * *